US011342713B2

(12) United States Patent
Zhang

(10) Patent No.: US 11,342,713 B2
(45) Date of Patent: May 24, 2022

(54) REVERSIBLE USB RECEPTACLE HAVING HIGH-FREQUENCY TRANSMISSION PROPERTIES

(71) Applicant: SHENZHEN EVERWIN PRECISION TECHNOLOGY CO LTD, Guangdong (CN)

(72) Inventor: Shaocan Zhang, Guangdong (CN)

(73) Assignee: SHENZHEN EVERWIN PRECISION TECHNOLOGY CO., LTD., Guangdong (CN)

( * ) Notice: Subject to any disclaimer, the term of this patent is extended or adjusted under 35 U.S.C. 154(b) by 0 days.

(21) Appl. No.: 17/041,222

(22) PCT Filed: Dec. 14, 2019

(86) PCT No.: PCT/CN2019/125435

§ 371 (c)(1),
(2) Date: Sep. 24, 2020

(87) PCT Pub. No.: WO2020/119818

PCT Pub. Date: Jun. 18, 2020

(65) Prior Publication Data

US 2021/0013682 A1 Jan. 14, 2021

(30) Foreign Application Priority Data

Dec. 15, 2018 (CN) ..... 201811537140.7

(51) Int. Cl.
*H01R 13/6581* (2011.01)
*H01R 24/64* (2011.01)
*H01R 43/16* (2006.01)

(52) U.S. Cl.
CPC ..... *H01R 13/6581* (2013.01); *H01R 24/64* (2013.01); *H01R 43/16* (2013.01)

(58) Field of Classification Search
CPC ..... H01R 13/6581; H01R 24/64; H01R 43/16
(Continued)

(56) References Cited

U.S. PATENT DOCUMENTS 4,847,993 A * 7/1989 Lin ..... H01R 43/16 29/874
9,219,325 B2 * 12/2015 Endo ..... H01R 13/46
(Continued)

FOREIGN PATENT DOCUMENTS

CN 201927762 U * 8/2011
CN 201927762 U 8/2011
(Continued)

OTHER PUBLICATIONS

International Search Report for International application No. PCT/CN2019/125435 dated Mar. 16, 2020.
(Continued)

*Primary Examiner* — Peter G Leigh
(74) *Attorney, Agent, or Firm* — W&G Law Group

(57) ABSTRACT

A reversible USB receptacle having high-frequency transmission properties, including a shielding middle plate (50), first and second terminal groups (30, 40) respectively located at upper and lower sides of the shielding middle plate (50), and an insulating body (20) making first and second terminal groups (30, 40) and the shielding middle plate (50) be formed into one piece, the insulating body (20) including a base and (21) a butting tongue portion (22) extending forward from the base (21), first and second terminal groups (30, 40) respectively including contact portions (35, 45) exposed on upper and lower surfaces of the butting tongue portion (22), retaining portions (36, 46) formed by extending backward from the contact portions (35, 45), and welding pins (37, 47) formed by extending from the retaining portions, wherein first and second termi-
(Continued)

nal groups (30, 40) further include bent portions (381, 481) formed by oppositely bending from front end edges of contact portions (35, 45), and material strip connecting portions (382, 482) extending from ends of bent portions beyond front end of the shielding middle plate (50), and the material strip connecting portions (382, 482) are embedded in the insulating body (20). The present disclosure can achieve high-frequency transmission and prevent the front end of the terminal from warping.

9 Claims, 5 Drawing Sheets

(58) Field of Classification Search
USPC ..... 439/607.01
See application file for complete search history.

(56) References Cited

U.S. PATENT DOCUMENTS 9,484,679 B2 * 11/2016 Guo ..... H01R 43/16
9,608,391 B2 * 3/2017 Little ..... H01R 12/724
9,843,148 B2 * 12/2017 Little ..... H01R 24/60
2017/0294753 A1 10/2017 Wu et al.
2017/0310501 A1 * 10/2017 Wang ..... H01R 12/7023
2018/0026410 A1 * 1/2018 Tsai ..... H01R 13/6583 439/607.09
2018/0062319 A1 * 3/2018 Chang ..... H01R 13/646
2018/0109042 A1 * 4/2018 Little ..... H01R 13/405
2019/0229481 A1 * 7/2019 Zhao ..... H01R 13/6585
2019/0252830 A1 * 8/2019 Zhao ..... H01R 13/6594

FOREIGN PATENT DOCUMENTS

CN 206271920 U * 6/2017
CN 206271920 U 6/2017
CN 207353544 U 5/2018
CN 109638521 A 4/2019
CN 209298415 U 8/2019

OTHER PUBLICATIONS

Written Opinion of the International Searching Authority for International application No. PCT/CN2019/125435 dated Mar. 16, 2020.

* cited by examiner

REVERSIBLE USB RECEPTACLE HAVING HIGH-FREQUENCY TRANSMISSION PROPERTIES

TECHNICAL FIELD

The present disclosure relates to the field of electrical connectors, and in particular, to a reversible USB receptacle having high-frequency transmission properties.

BACKGROUND

A Type C connector is a transmission interface with high transmission speed, in addition, it also improves a reversible function. Therefore, in order to support the change, a Type C receptacle is provided with first and second terminal groups arranged symmetrically up and down, and a shielding middle plate located between the first and second terminal groups to shield high-frequency signal interference.

In traditional manufacturing, during a first molding process of the first and second terminal groups, front and rear ends of the first and second terminal groups are each connected with a material strip to fix the first and second terminal groups. The front ends of the first and second terminal groups generally adopt punching and thinning technology, to make punched and thinned positions of front end edges of the first and second terminal groups be embedded in a plastic body after the last injection molding. However, due to a limited size of the punching and thinning, it easily causes problems such as loose plastic encapsulation or extremely thin encapsulation, and during insertion of a plug connector, a terminal of the plug may easily damage the encapsulation, resulting in a risk of the terminal of the receptacle being warping and damaged.

SUMMARY

In view of this, it is necessary to provide a reversible USB receptacle that supports high-frequency signal transmission and terminals thereof are easily to wrap.

In order to solve the above technical problems, a reversible USB receptacle having high-frequency transmission properties is provided, including a shielding middle plate, first and second terminal groups respectively located at upper and lower sides of the shielding middle plate, and an insulating body making the first and second terminal groups and the shielding middle plate be formed into one piece. The insulating body includes a base and a butting tongue portion formed by extending forward from the base; the first and second terminal groups respectively include contact portions exposed on upper and lower surfaces of the butting tongue portion, retaining portions formed by extending backward from the contact portions, and welding pins formed by extending from the retaining portions, the first and second terminal groups further include bent portions formed by oppositely bending from front end edges of the contact portions, and material strip connecting portions extending from ends of the bent portions beyond a front end of the shielding middle plate, and the material strip connecting portions are embedded in the insulating body.

Preferably, the first and second terminal groups each sequentially include, in a lateral direction, a ground terminal, a high-frequency terminal, a power terminal, a signal terminal, a power terminal, a high-frequency terminal, and a ground terminal.

Preferably, the material strip connecting portions of the high-frequency terminals of the first and second terminal groups are staggered in a vertical projection direction.

Preferably, a width of the material strip connecting portion of the high-frequency terminal of each of the first and second terminal groups is smaller than ½ of a width of the high-frequency terminal.

Preferably, the shielding middle plate includes a main body portion, a groove formed at a laterally outer side of the main body portion, and a welding portion formed by extending from a rear end of the main body portion, a portion of the front end of the shielding middle plate located between the power terminal and the signal terminal is cut out to form a cut-out portion, such that no shielding middle plate exists between the power terminal and the material strip connecting portion at a front end of the signal terminal.

Preferably, the shielding middle plate includes a main body portion, a groove formed at a laterally outer side of the main body portion, and a welding portion formed by extending from a rear end of the main body portion, a portion of the front end of the shielding middle plate located between the power terminal and the signal terminal is completely cut out along a plug-in direction to form a cut-out portion, such that no shielding middle plate exists between the power terminal and the signal terminal, and the cut-out portion divides the shielding middle plate into two independent parts on left and right.

Preferably, a portion of the front end of the main body portion of the shielding middle plate located at two sides of the cut-out portion is punched and thinned to form a punched and thinned portion, and a position of the punched and thinned portion is correspondingly located between the high-frequency terminals of the first and second terminal groups.

Preferably, the bent portions of the front end edges of the contact portions of the high-frequency terminals of the first and second terminal groups are located at a front end edge of the punched and thinned portion.

Preferably, upper and lower side surfaces of the punched and thinned portion are both punched and thinned, a thickness of the punched and thinned portion is smaller than a thickness of the main body portion, and distances from the upper and lower surfaces of the punched and thinned portion to the upper and lower surfaces of the main body portion are equal to each other.

Preferably, no shielding middle plate exists between the ground terminal, the power terminal, the bent portion of the front end edge of the contact portion of the signal terminal, and the material strip connecting portion.

The reversible USB receptacles having high-frequency transmission properties in the present disclosure, by arranging the material strip connecting portions of the high-frequency signal terminals of the first and second terminal groups in a staggered manner, can effectively reduce high-frequency signal interference between the first and second terminal groups, moreover, forming the material strip connecting portions in such a way that the front end edges of the first and second terminal groups are oppositely bent and then extend can cause the material strip connecting portions to be buried deeper in the insulating body, thereby solving an existing defect that the front ends are easily to warp when the front end edges of the first and second terminal groups are punched and thinned.

BRIEF DESCRIPTION OF DRAWINGS

The accompany drawings described herein are used to provide a further illustration of the present disclosure and constitute a part of the present disclosure, and embodiments of the present disclosure and the description thereof are used to explain the present disclosure and do not constitute an improper limitation on the present disclosure.

DESCRIPTION OF EMBODIMENTS

In order to make the purpose, technical solutions and advantages of the present disclosure clearer, the technical solutions of the present disclosure will be described in mores details with reference to the embodiments and corresponding drawings of the present disclosure. It should be noted the described embodiments are only a part of the embodiments of the present disclosure, rather than all the embodiments. Based on the embodiments in the present disclosure, all other embodiments obtained by those of ordinary skill in the art without creative work shall fall within the protection scope of the present disclosure.

Figure 1:
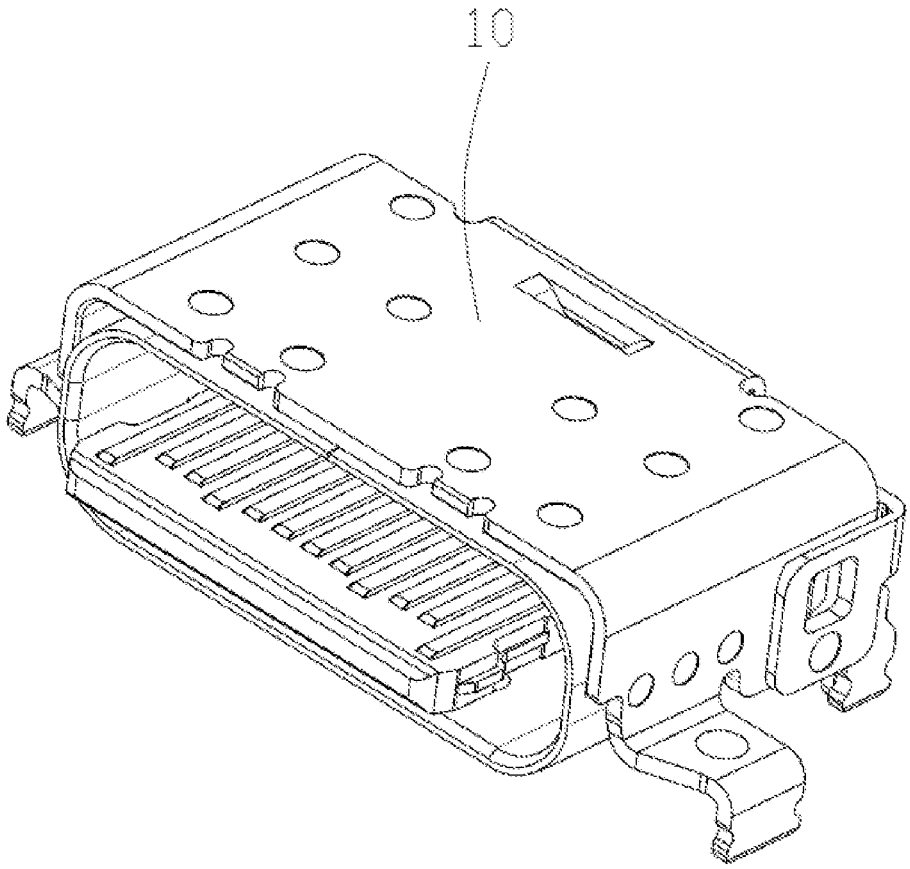
FIG. 1 is a perspective combination diagram of a reversible USB receptacle of the present disclosure.
Figure 2:
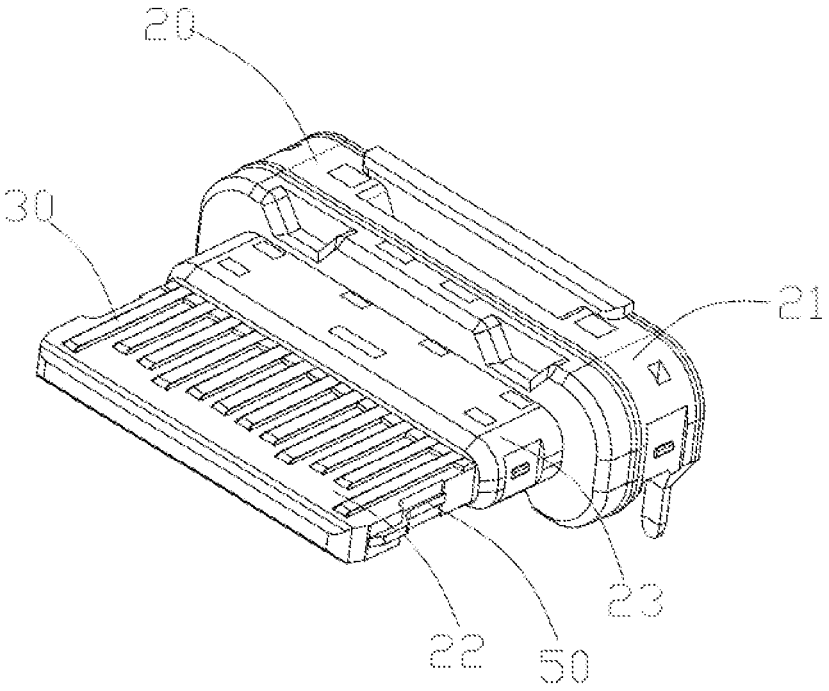
FIG. 2 is a perspective diagram of a reversible USB receptacle of the present disclosure, with a metal shell being removed.
Figure 3:
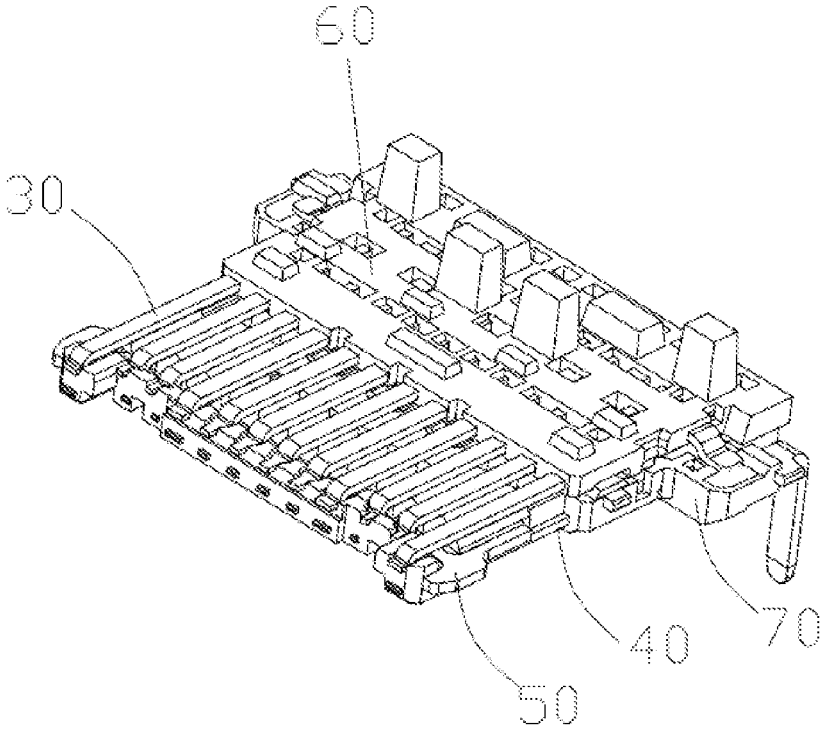
FIG. 3 is a perspective diagram of a reversible USB receptacle of the present disclosure, with a metal shell and a third insulator being removed.

Referring to FIG. 1, FIG. 2, and FIG. 3, a reversible USB receptacle having high-frequency transmission properties of the present disclosure includes a shielding middle plate 50, first and second terminal groups 30, 40 respectively located at upper and lower sides of the shielding middle plate 50, a first insulator 60 formed on the first terminal group 30, a second insulator 70 formed on the second terminal group 40 and the shielding middle plate 50, an insulating body 20 making the first and second insulators 60, 80 be formed into one piece, and a metal shell 10 covering the insulating body 20.

The insulating body 20 includes a base 21, a butting tongue portion 22 extending forward from the base 21, and a step portion 23 formed between the butting tongue portion 22 and the base 21.

Figure 5:
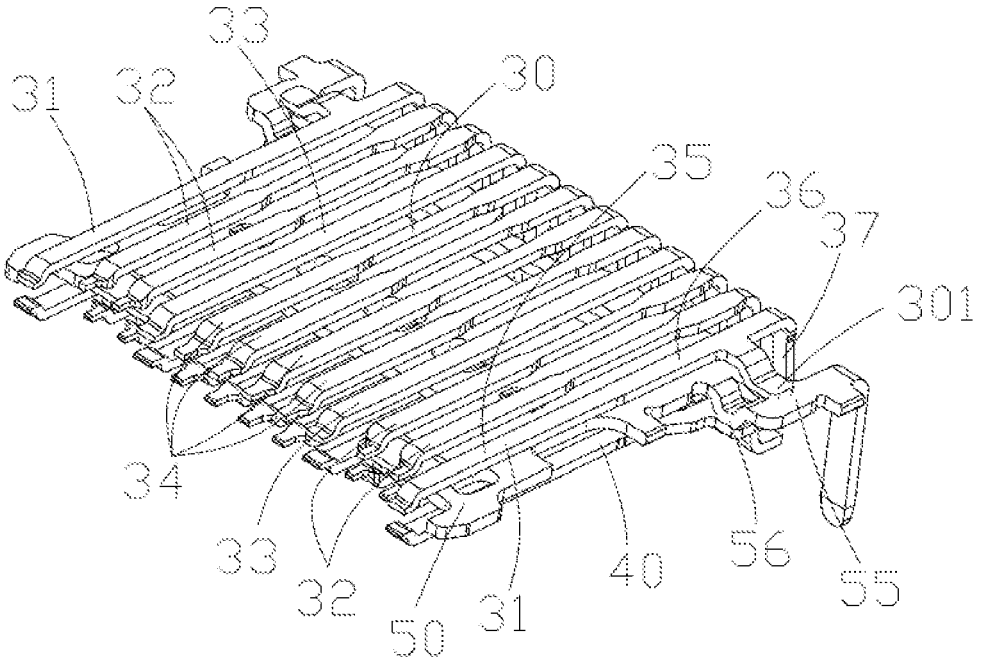
FIG. 5 is a combination diagram of first and second terminal groups and a shielding middle plate of a reversible USB receptacle of the present disclosure.
Figure 6:
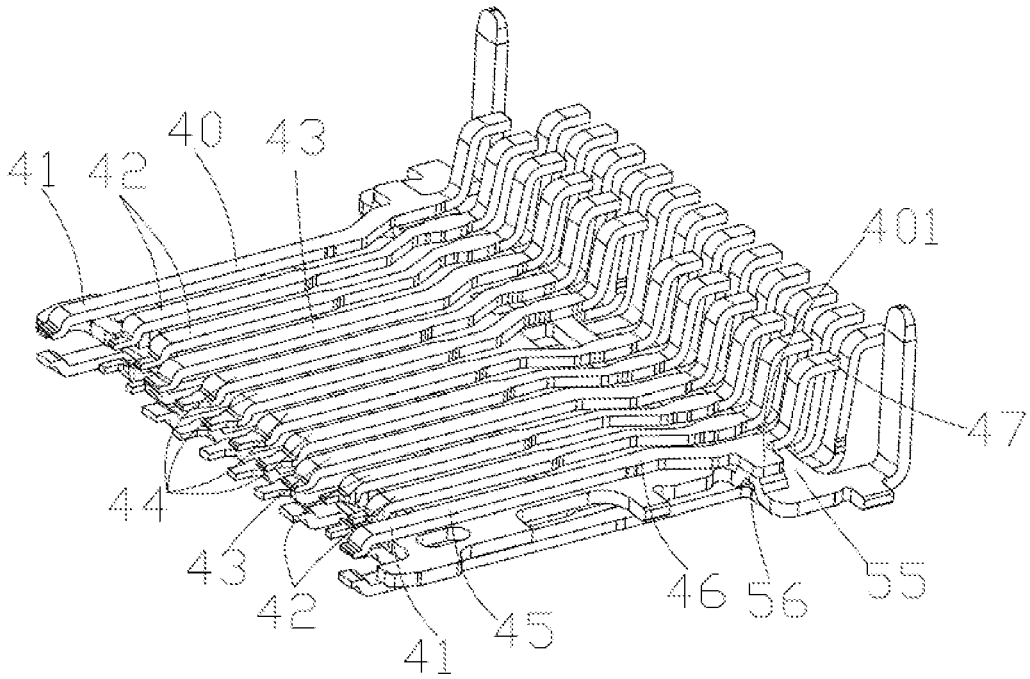
FIG. 6 is a combination diagram of first and second terminal groups and a shielding middle plate of a reversible USB receptacle of the present disclosure from another perspective.

With continued reference to FIG. 5 and FIG. 6, the first and second terminal groups 30, 40 include respective contact portions 35, 45 exposed on upper and lower surfaces of the butting tongue portion 22, retaining portions 36, 46 formed by extending backward from the contact portions 35, 45, and welding pins 37, 47 formed by extending from the retaining portions 36, 46.

The first and second terminal groups 30, 40 sequentially include, in a transverse direction, ground terminals 31, 41, a pair of high-frequency terminals 32, 42, power terminals 33, 43, several signal terminals 34, 44, power terminals 33, 43, a pair of high-frequency terminals 32, 42 and ground terminals 31, 41. The high-frequency terminals 32, 42 are used to transmit high-frequency signals, and the signal terminals 34, 44 can be used to transmit low-frequency signals or high-frequency signals.

A rear end of the retaining portion 36 of the ground terminal 31 of the first terminal group 30 is bent and extending laterally and outwardly toward the shielding middle plate 50, to form a first abutting portion 301. A rear end of the retaining portion 46 of the ground terminal 41 of the second terminal group 40 extends laterally and outwardly to form a second abutting portion 401.

Figure 4:
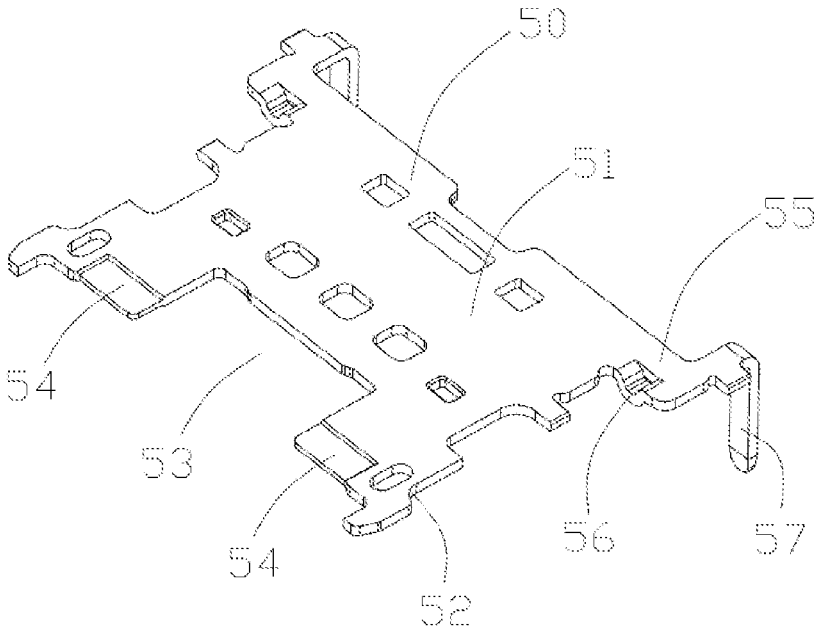
FIG. 4 is a perspective diagram of a shielding middle plate of the reversible USB receptacle shown in FIG. 3.

With continued reference to FIG. 4, the shielding middle plate 50 includes a main body portion 51, a groove 52 formed at a laterally outer side of the main body portion 51 to be buckled with the butting plug, an extension portion 55 formed by extending from a rear end of the main body portion 51 toward the laterally outer side, and a welding portion 57 formed by being bent and extending from the extension portion 55. In the present embodiment, the shielding middle plate 50 is a left-right integrated structure, however, a cut-out portion 53 is formed by cutting at a front end of a middle part of the main body portion 51, and the cut-out portion 53 is correspondingly located between the power terminals 33, 43 and the signal terminals 34, 44; in other embodiments, a middle part of the main body portion 51 may be completely cut out, that is, the cut-out portion 53 is completely cut out along a plug-in direction to divide the shielding middle plate 50 into two independent parts on left and right, and in this case, the cut-out portion 53 is located between the power terminals 33, 43 and the signal terminals 34, 44, that is, there is no shielding middle plate 50 between the power terminals 33, 43 and the signal terminals 34, 44.

A portion of the front end of the main body portion 51, which is located at two sides of the cut-out portion 53, is punched and thinned to form a punched and thinned portion 54, and upper and lower side surfaces of the punched and thinned portion 54 are both punched and thinned, that is, a thickness of the punched and thinned portion 54 is smaller than a thickness of the main body portion 51, and distances from upper and lower surfaces of the punched and thinned portion 54 to the upper and lower surfaces of the main body portion 51 are equal to each other. A position of the punched and thinned portion 54 is correspondingly located between the high-frequency terminals 32, 42, so as to shield interference between high-frequency signals.

The first abutting portion 301 of the first terminal group 30 is bent and extending toward the shielding middle plate 50 and then electrically contacts the lateral extension portion 55 of the shielding middle plate 50. A partial position of the extension portion 55 of the shielding middle plate 50 is stamped toward a side of the second terminal group 40 to form a protruding portion 56, and the protruding portion 56 is electrical contact with the second abutting portion 401 of the second terminal group 40. The first and second abutting portions 301 and 401 are in contact with the extension portion 55 of the shielding middle plate 50 in a staggered manner along the plug-in direction. Thus, it is achieved that the ground terminals 31, 41 are electrically connected to the shielding middle plate 50 to improve shielding performance of the shielding middle plate 50.

Figure 7:
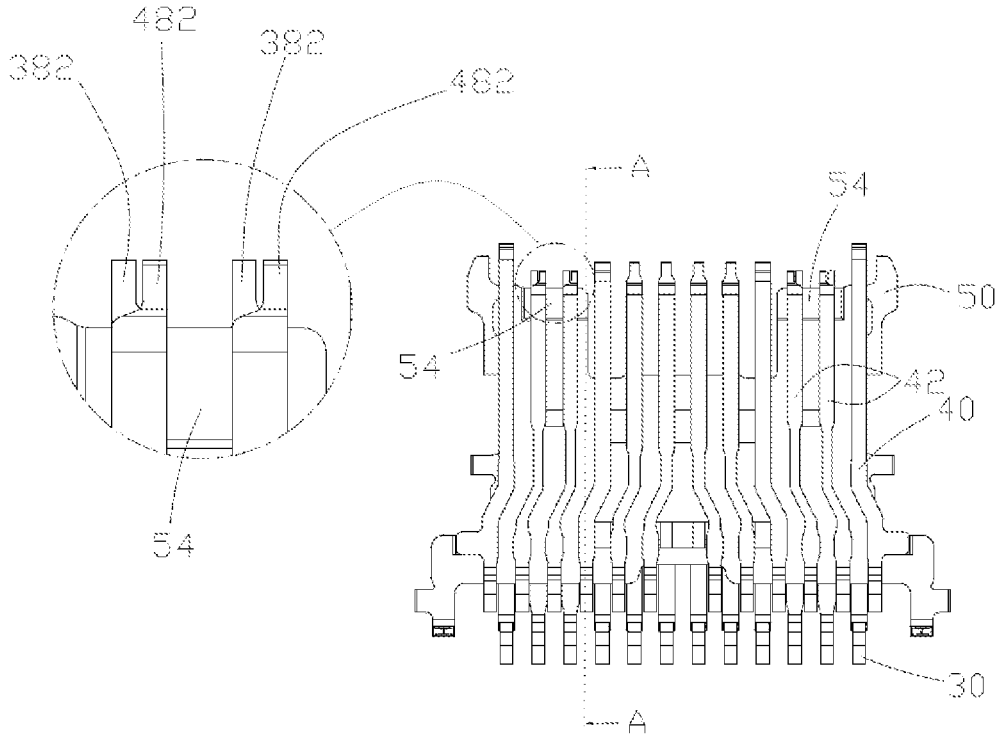
FIG. 7 illustrates a top diagram and a partially enlarged diagram of first and second terminal groups and a shielding middle plate of a reversible USB receptacle of the present disclosure.
Figure 8:
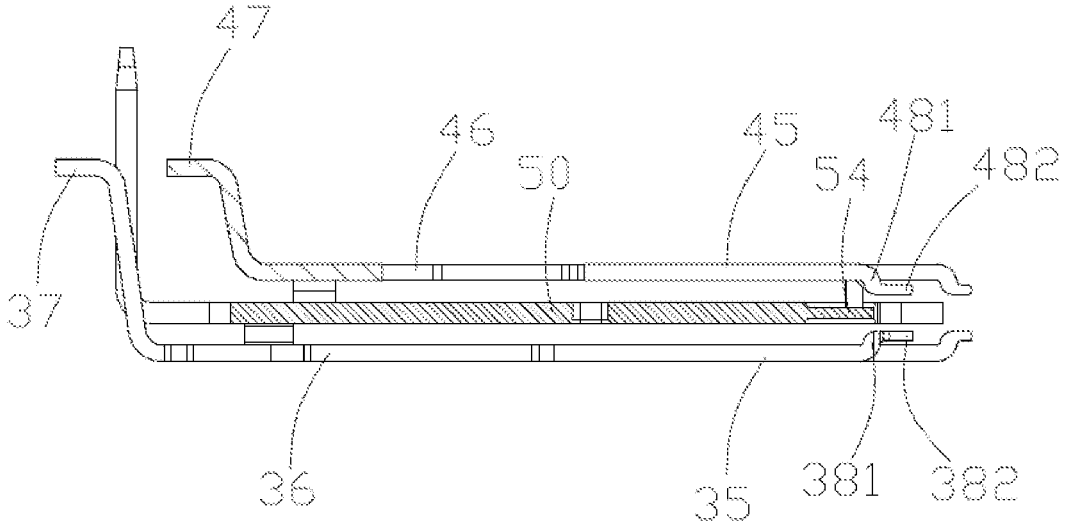
FIG. 8 is a cross-sectional diagram taken along a broken line A-A shown in FIG. 7.

With continued reference to FIG. 7 and FIG. 8, the front ends of the contact portions 35, 45 of the first and second terminal groups 30, 40 are bent oppositely and then extend to form bent portions 381, 481 and material strip connecting portions 382, 482. The material strip connecting portions 382, 482 extend beyond the front end of the shielding middle plate 50, that is, there is no shielding middle plate 50 between the material strip connecting portions 382, 482.

The bent portions 381, 481 of the high-frequency terminals 32, 42 are located at a front end edge of the punched and thinned portion 54 of the shielding middle plate 50, and in this case, the punched and thinned portion 54 increases a distance between the bent portions 381, 481 and the surface of the punched and thinned portion 54, making it possible to avoid a short circuit between the bent portions 381, 481 of the high-frequency terminals 32, 42 and the shielding middle plate 50 due to processing technology or other factors. In this case, the bent portions 381, 482 of the high-frequency terminals 32, 42 of the first and second terminal groups 30, 40 are still located on the upper and lower sides of the punched and thinned portion 54.

The material strip connecting portions 382, 482 of the high-frequency terminals 32, 42 extend beyond the front end edge of the punched and thinned portion 54, and in this case, the material strip connecting portions 382, 482 of the high-frequency terminals 32, 42 are partially cut out in a width direction of the terminals, such that the material strip connecting portion 382 of the high-frequency terminal 32 of the first terminal group 30 and the material strip connecting portion 482 of the high-frequency terminal 42 of the second terminal group 40 are arranged to be staggered in a vertical direction. That is, in this case, there is no shielding middle plate 50 between the material strip connecting portions 382, 482 of the high-frequency terminals 32, 42 of the first and second terminal groups 30, 40, so as to reduce high-frequency signal interference between the first and second terminal groups 30, 40, the material strip connecting portions 382, 482 of the high-frequency terminals 32, 42 of the first and second terminal groups 30, 40 are staggered in a vertical projection direction, which can reduce high-frequency signal interference between the material strip connecting portions 382, 482.

The reversible USB receptacles having high-frequency transmission properties in the present disclosure, by arranging the material strip connecting portions 382, 482 of the high-frequency signal terminals 32, 42 of the first and second terminal groups 30, 40 in a staggered manner, can effectively reduce high-frequency signal interference between the first and second terminal groups 30, 40, moreover, forming the material strip connecting portions 382, 482 in such a way that the front end edges of the first and second terminal groups 30, 40 are oppositely bent and then extend can cause the material strip connecting portions 382, 482 to be buried deeper in the insulating body 20, thereby solving an existing defect that the front ends are easily to warp when the front end edges of the first and second terminal groups are punched and thinned.

Moreover, in the present disclosure, the ground terminals 31, 41 of the first and second terminal groups 30, 40 are in electrical contact with the shielding middle plate 50 by forming the first and second abutting portions 301, 401, respectively, making the shielding performance of products better.

The above descriptions are only embodiments of the present disclosure and are not intended to limit the present disclosure. For those skilled in the art, the present disclosure can have various modifications and changes. Any modification, equivalent replacement, improvement, etc. made within the principle of the present disclosure shall be included in the scope of the claims of the present disclosure.

What is claimed is:

1. A reversible USB receptacle having high-frequency transmission properties, comprising:

a shielding middle plate;

first and second terminal groups respectively located at upper and lower sides of the shielding middle plate; and an insulating body making the first and second terminal groups and the shielding middle plate be formed into one piece;

the insulating body comprising a base and a butting tongue portion formed by extending forward from the base;

the first and second terminal groups respectively comprising contact portions exposed on upper and lower surfaces of the butting tongue portion, retaining portions formed by extending backward from the contact portions, and welding pins formed by extending from the retaining portions;

wherein the first and second terminal groups further comprise bent portions formed by oppositely bending from front end edges of the contact portions, and material strip connecting portions extending from ends of the bent portions beyond a front end of the shielding middle plate, and the material strip connecting portions are embedded in the insulating body, wherein a portion of the front end of the shielding middle plate is punched and thinned to form a thinned portion; the first and second terminal groups each comprise a high-frequency terminal; and the bent portions at the front end edges of the contact portions of the high-frequency terminals of the first and second terminal groups are located at a front end edge of the thinned portion.

2. The reversible USB receptacle having high-frequency transmission properties according to claim 1, wherein the first and second terminal groups each sequentially comprise, in a lateral direction, a ground terminal, a high-frequency terminal, a power terminal, a signal terminal, a power terminal, a high-frequency terminal, and a ground terminal.

3. The reversible USB receptacle having high-frequency transmission properties according to claim 2, wherein the material strip connecting portions of the high-frequency terminals of the first and second terminal groups are staggered in a vertical projection direction.

4. The reversible USB receptacle having high-frequency transmission properties according to claim 3, wherein a width of the material strip connecting portion of the high-frequency terminal of each of the first and second terminal groups is smaller than ½ of a width of the high-frequency terminal.

5. The reversible USB receptacle having high-frequency transmission properties according to claim 3, wherein the shielding middle plate comprises a main body portion, a groove formed at a laterally outer side of the main body portion, and a welding portion formed by extending from a rear end of the main body portion; and a portion of the front end of the shielding middle plate located between the power terminal and the signal terminal is cut out to form a cut-out portion, such that no shielding middle plate exists between the power terminal and the material strip connecting portion at a front end of the signal terminal.

6. The reversible USB receptacle having high-frequency transmission properties according to claim 3, wherein the shielding middle plate comprises a main body portion, a groove formed at a laterally outer side of the main body portion, and a welding portion formed by extending from a rear end of the main body portion; a portion of the front end of the shielding middle plate located between the power terminal and the signal terminal is completely cut out along a plug-in direction to form a cut-out portion, such that no shielding middle plate exists between the power terminal and the signal terminal, and the cut-out portion divides the shielding middle plate into two independent parts on opposite sides of the cut-out portion.

7. The reversible USB receptacle having high-frequency transmission properties according to claim 6, wherein the portion of the front end of the shielding middle plate that is punched and thinned to form the thinned portion is located at two sides of the cut-out portion, and a position of the thinned portion is correspondingly located between the high-frequency terminals of the first and second terminal groups.

8. The reversible USB receptacle having high-frequency transmission properties according to claim 6, wherein upper and lower side surfaces of the thinned portion are both punched and thinned, a thickness of the thinned portion is smaller than a thickness of the main body portion, and distances from the upper and lower surfaces of the thinned portion to the upper and lower surfaces of the main body portion are equal to each other.

9. The reversible USB receptacle having high-frequency transmission properties according to claim 1, wherein no shielding middle plate exists between the bent portions of the ground terminals of the first and second terminal groups, and between the bent portions of the signal terminals of the first and second terminal groups; and no shielding middle plate exists between the material strip connecting portions of the ground terminals of the first and second terminal groups, between the material strip connecting portions of the power terminals of the first and second terminal groups, and between the material strip connecting portions of the signal terminals of the first and second terminal groups.

* * * * *